US011110586B2

(12) United States Patent
Chin-Chen

(10) Patent No.: US 11,110,586 B2
(45) Date of Patent: Sep. 7, 2021

(54) MULTI-FUNCTIONAL TOOL STRUCTURE

(71) Applicant: Huang Chin-Chen, Taichung (TW)

(72) Inventor: Huang Chin-Chen, Taichung (TW)

( * ) Notice: Subject to any disclaimer, the term of this patent is extended or adjusted under 35 U.S.C. 154(b) by 349 days.

(21) Appl. No.: 16/189,837

(22) Filed: Nov. 13, 2018

(65) Prior Publication Data

US 2020/0147779 A1 May 14, 2020

(51) Int. Cl.

| | |
|---|---|
| ***B25B 17/00*** | (2006.01) |
| ***B25G 1/08*** | (2006.01) |
| ***B25B 23/00*** | (2006.01) |
| ***B25F 1/02*** | (2006.01) |

(52) U.S. Cl.

CPC ..... *B25G 1/085* (2013.01); *B25B 23/0035* (2013.01); *B25F 1/02* (2013.01)

(58) Field of Classification Search

CPC .. B25G 1/085; B25G 3/36; B25G 1/08; B25B 23/0035; B25B 15/02; B25F 1/02; B23B 2240/04

USPC ..... 81/489, 490, 177.4, 177.85

See application file for complete search history.

(56) References Cited

U.S. PATENT DOCUMENTS

| | | | | |
|---|---|---|---|---|
| 5,924,339 | A * | 7/1999 | Huang | B25G 1/085 81/57.3 |
| 6,293,173 | B1 * | 9/2001 | Rowlay | B25B 15/04 81/177.4 |
| 6,843,153 | B1 * | 1/2005 | Rawson-Harris | B25G 1/063 81/177.9 |
| 2003/0015070 | A1 * | 1/2003 | Chen | B25G 1/063 81/177.9 |
| 2004/0007095 | A1 * | 1/2004 | Meng | B23B 51/10 81/53.2 |

* cited by examiner

*Primary Examiner* — Orlando E Aviles
*Assistant Examiner* — Donna Maynard

(57) ABSTRACT

This invention is a multi-functional tool structure, consisting of a handle, a base, a cover and a sleeve. The base is engaged to the handle, and has multiple slots for placing tool heads, while the bottom part is provided with tool positioning recesses for fixing tool heads. The sleeve is set on the base, and has a side opening. Hence, when the side opening is set in line with the too heads by the rotation of the sleeve, the tool head can be removed from the side opening, and fixed to the tool fixing recess on the base before use.

7 Claims, 11 Drawing Sheets

MULTI-FUNCTIONAL TOOL STRUCTURE

BACKGROUND OF THE INVENTION

Technical Field

The present invention is a multi-functional tool structure, and in particular a structure which can store different types of tool heads.

Prior Art

A commercially available hand tool which is commonly used for screw locking, consists of a handle and screwdriver heads which are fixed and unremovable. This type of hand tool with commercial specifications not only has longer screwdriver heads, but also requires the use of different hand tools which correspond to locking parts with different specifications before use. When a workplace requires the use of many locking parts with different specifications, the user needs to carry many hand tools with different specifications, which are quite inconvenient to carry and use.

Although there are many hand tools available in the market which can replace screwdriver heads, these hand tools are bulky in sizes, not convenient to store or cannot be easily removed due to tight arrangements, thereby leading to troublesome inconvenience while in use.

Therefore, the inventor of the present invention has actively carried out researches and improvements for years using his practical experiences in related designs. In addition, the inventor has created and tested physical samples multiple times, thereby improved the shortcomings mentioned above, and eventually completed the present invention.

SUMMARY OF THE INVENTION

To overcome the shortcomings above, the present invention offers a multi-functional tool structure, which allows the side opening to correspond to different slots by the rotation of the sleeve, thereby easier for removing the corresponding tool heads.

The present invention is a multi-functional tool structure, consisting of:

A handle, where its top part comprises an annular opening and at least two engaging recesses, and each engaging recess is recessed equidistantly on the inner surface of the annular opening;

A base, where it comprises multiple stops, multiple slots and a bottom part; the stops and slots are arranged in a staggered manner on the outer periphery of the base, and the top end of each stop has a first joint, while the outer side of one of the stops has an elastic assembly; the slot is used for accommodating tool head, and the bottom part has at least two engaging protrusions and a tool fixing recess; the engaging protrusion is used for engaging the engaging recesses on the handle, and the tool fixing recess is used for fixing the tool head;

A cover, where multiple second joints are provided on its bottom surface, and are used for connecting the first joints on the base;

A sleeve, where it is hollow and comprises a side opening and multiple grooves; the side opening is recessed on one side of the sleeve, while multiple grooves are designed on the inner surface of the sleeve; the sleeve is set on the base and located between the handle and the cover, while the elastic assembly is abutted against the grooves; in addition, when the sleeve is rotated by an external force, the elastic assembly is temporarily deformed in order to switch to the corresponding groove;

Therefore, while in use, after the handle is separated from the base, the side opening will correspond to one of the tool heads by rotation of the sleeve, such that the tool head can be removed from the side opening, and fixed to the tool fixing recess on the base before use.

The following is a detailed description of specific embodiment and drawings, so that the review committee has a better understanding of the technical features of the present invention.

DETAILED DESCRIPTION

Figure 1:
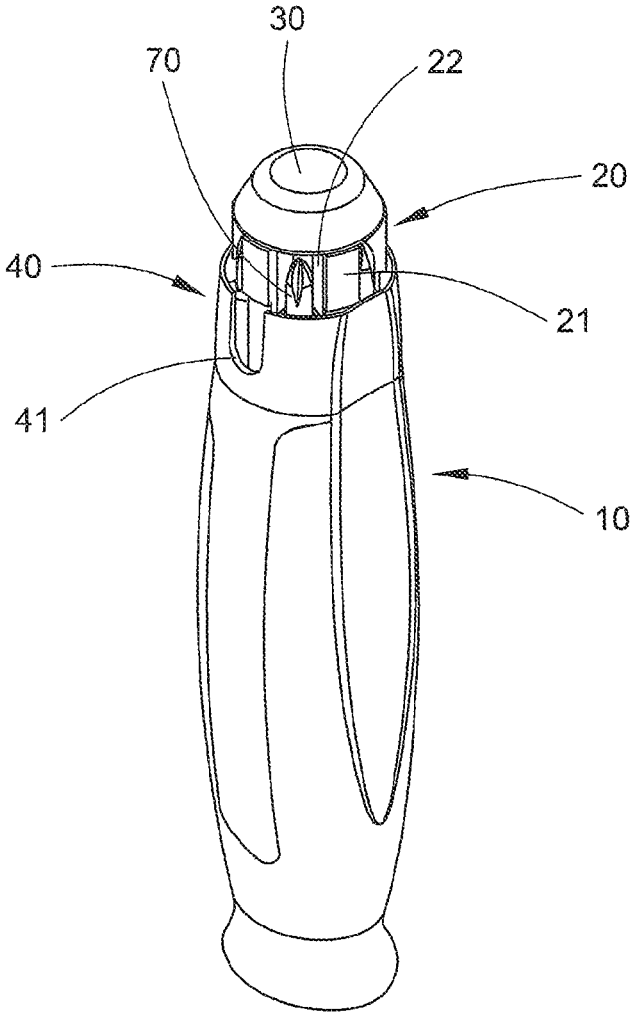
FIG. 1 is a perspective view of a multi-functional tool structure in an embodiment of the present invention.
Figure 2:
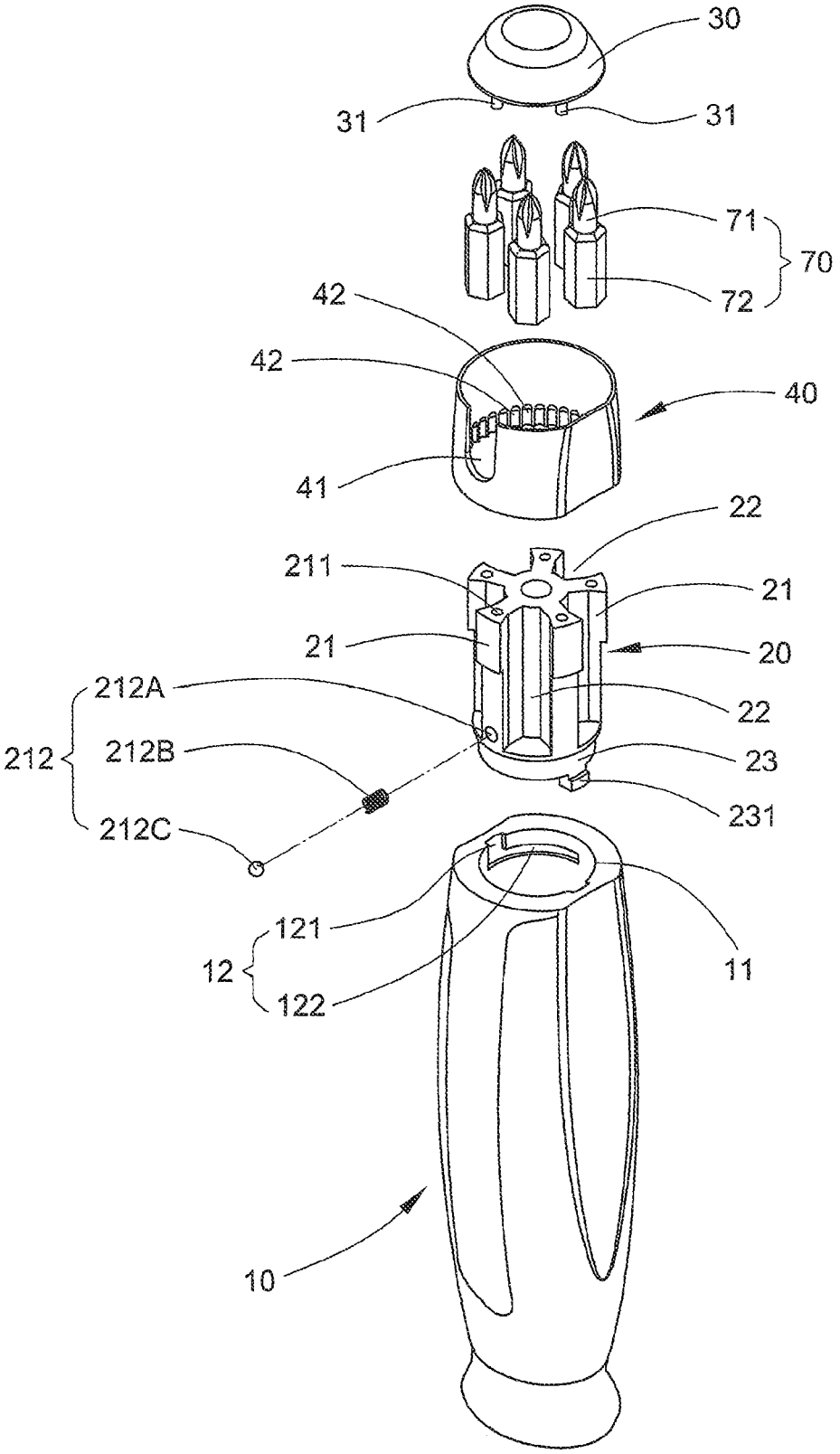
FIG. 2 is an exploded perspective view of a multi-functional tool structure in an embodiment of the present invention.
Figure 3:
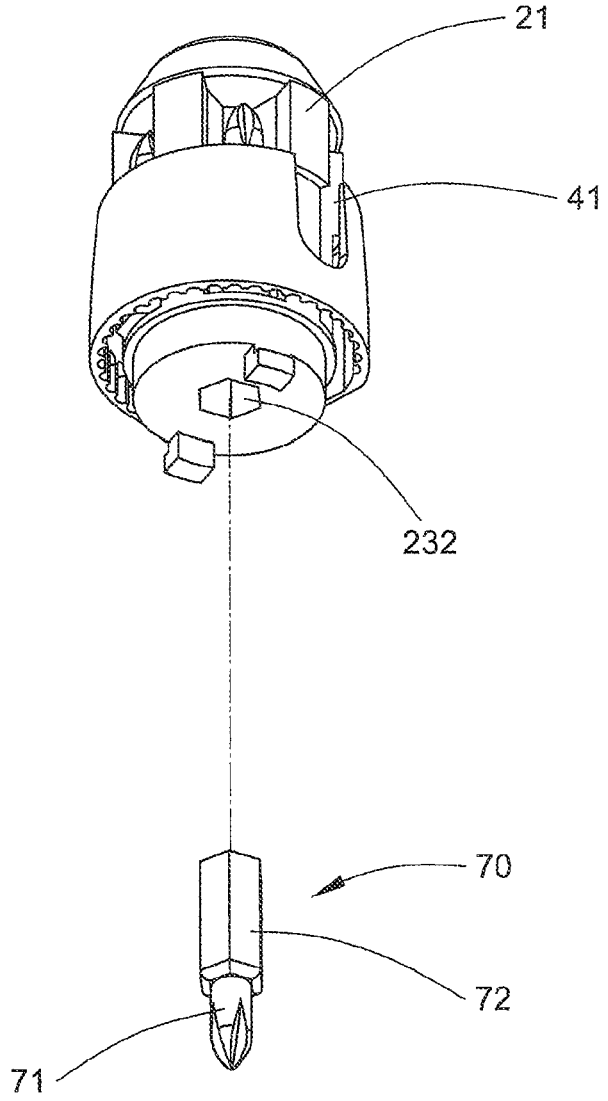
FIG. 3 is a perspective view of a tool head assembly in an embodiment of the present invention.
Figure 4:
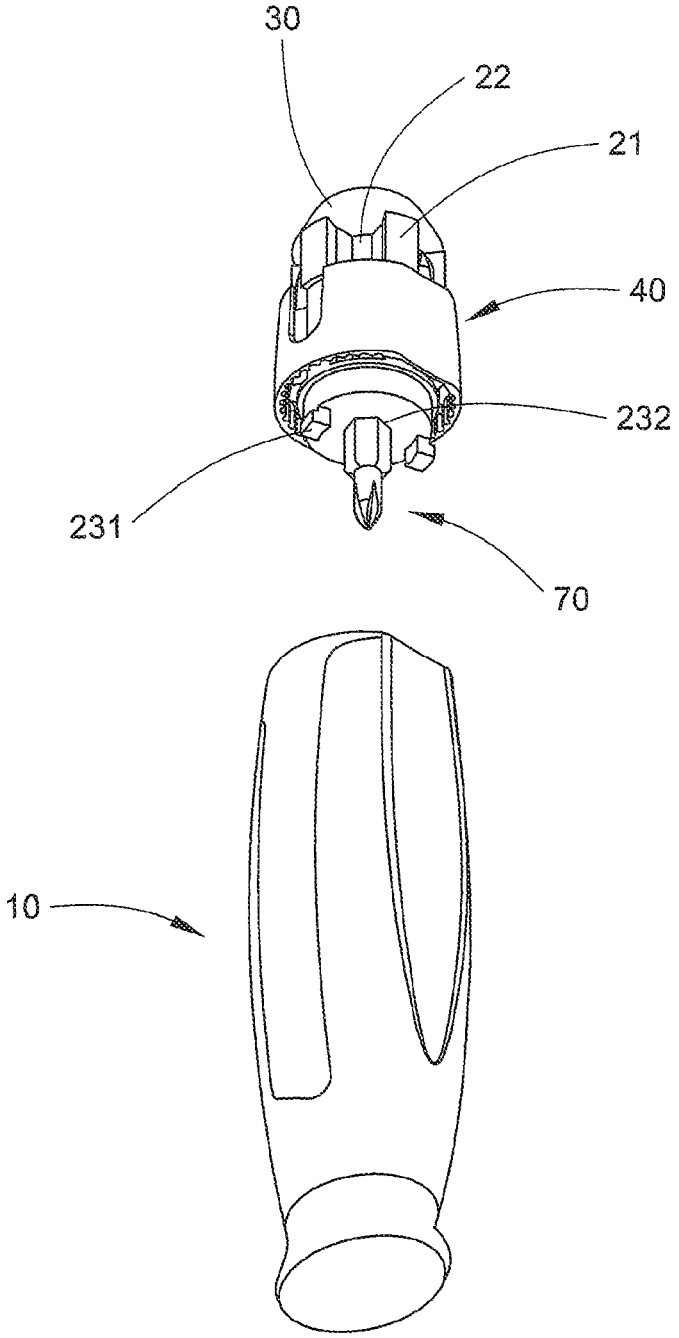
FIG. 4 is a perspective view of a tool head in an embodiment of the present invention after assembly.
Figure 5:
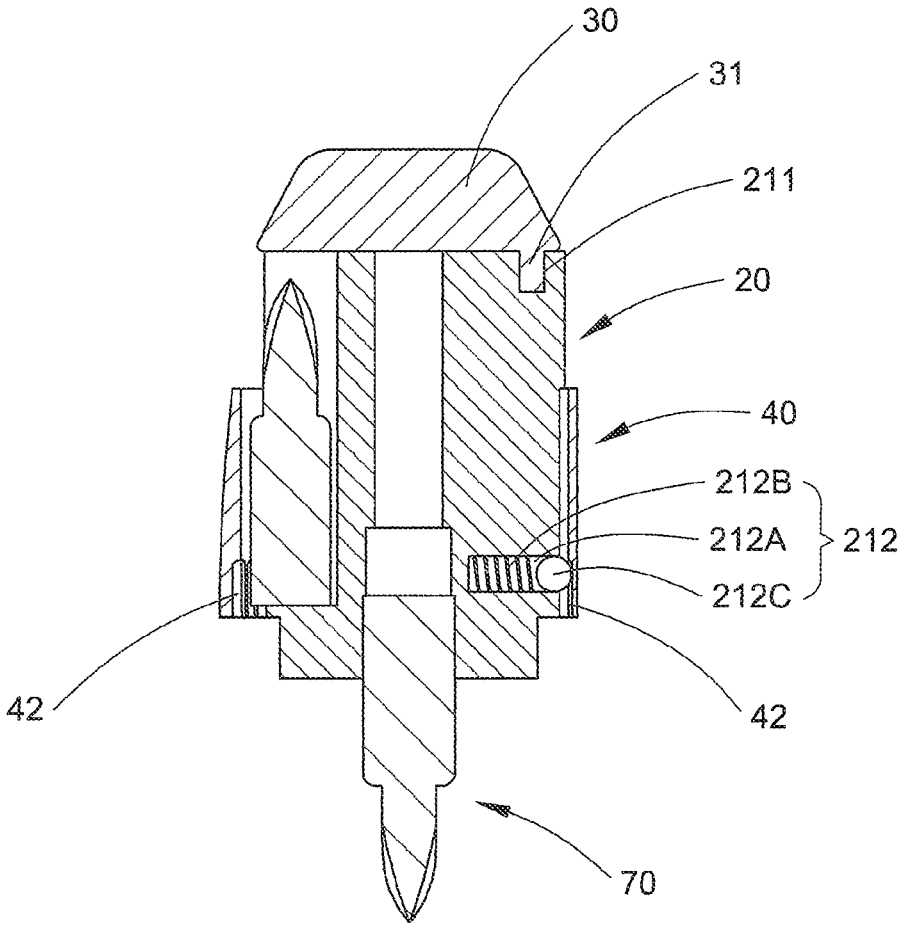
FIG. 5 is a cross-sectional view of an elastic assembly and grooves in an embodiment of the present invention.
Figure 6:
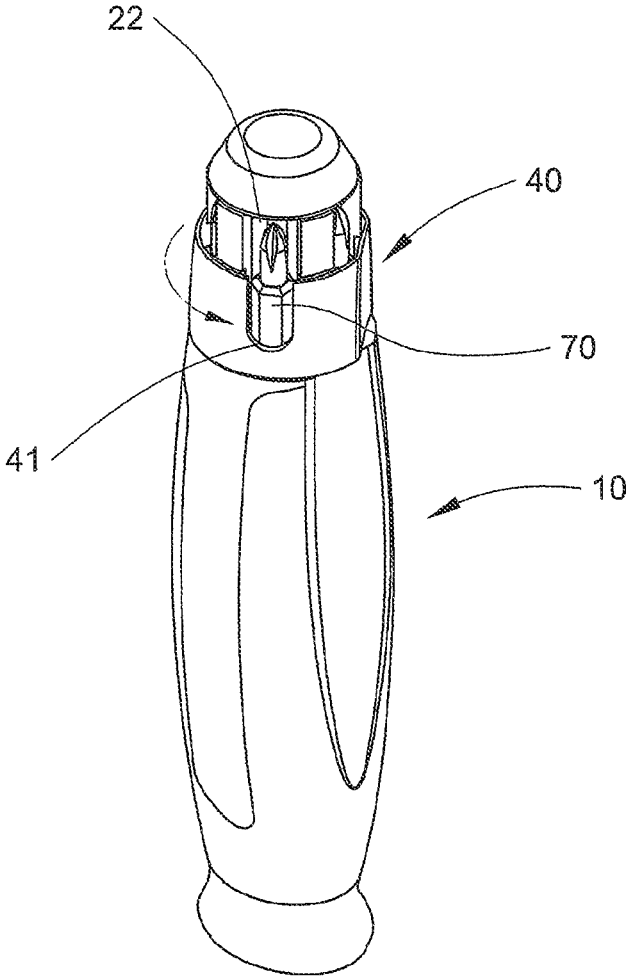
FIG. 6 illustrates a first step for removing a tool head.
Figure 7:
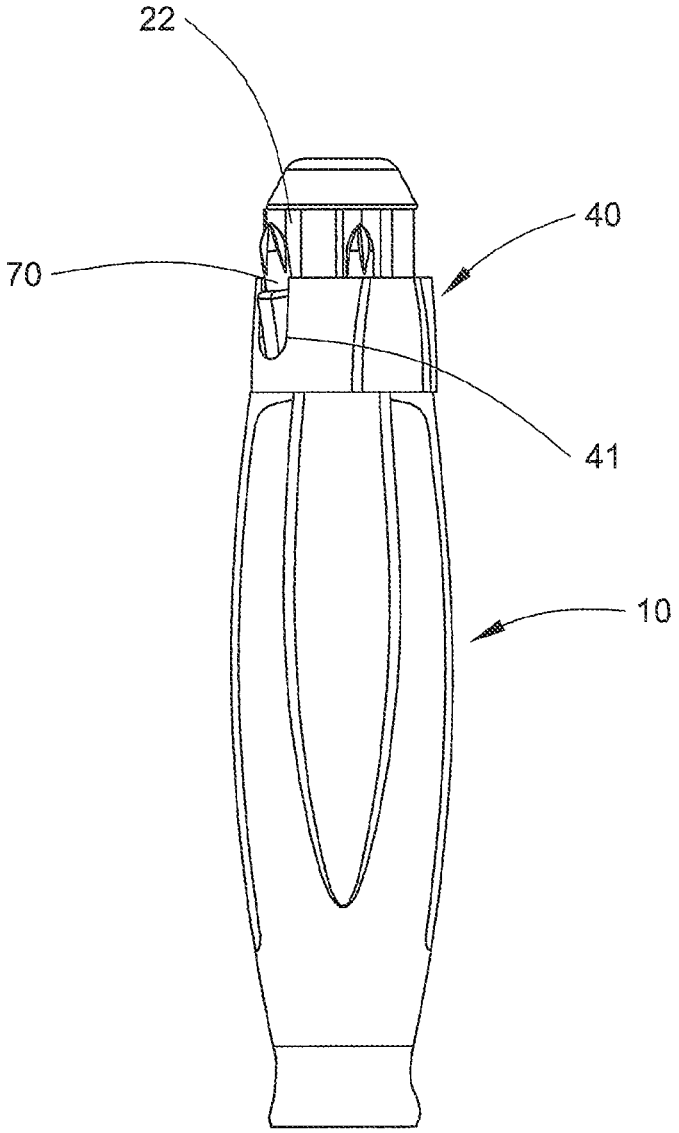
FIG. 7 illustrates a first step for removing a tool head.
Figure 8:
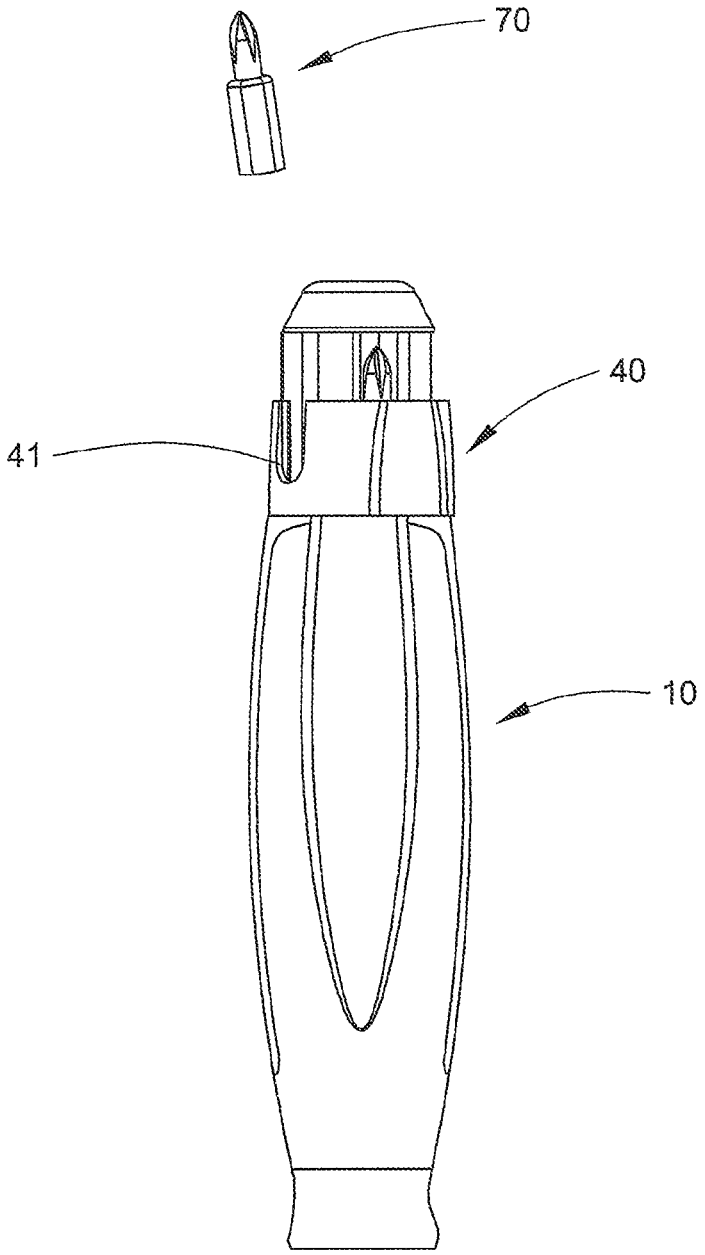
FIG. 8 illustrates a third step for removing a tool head.
Figure 9:
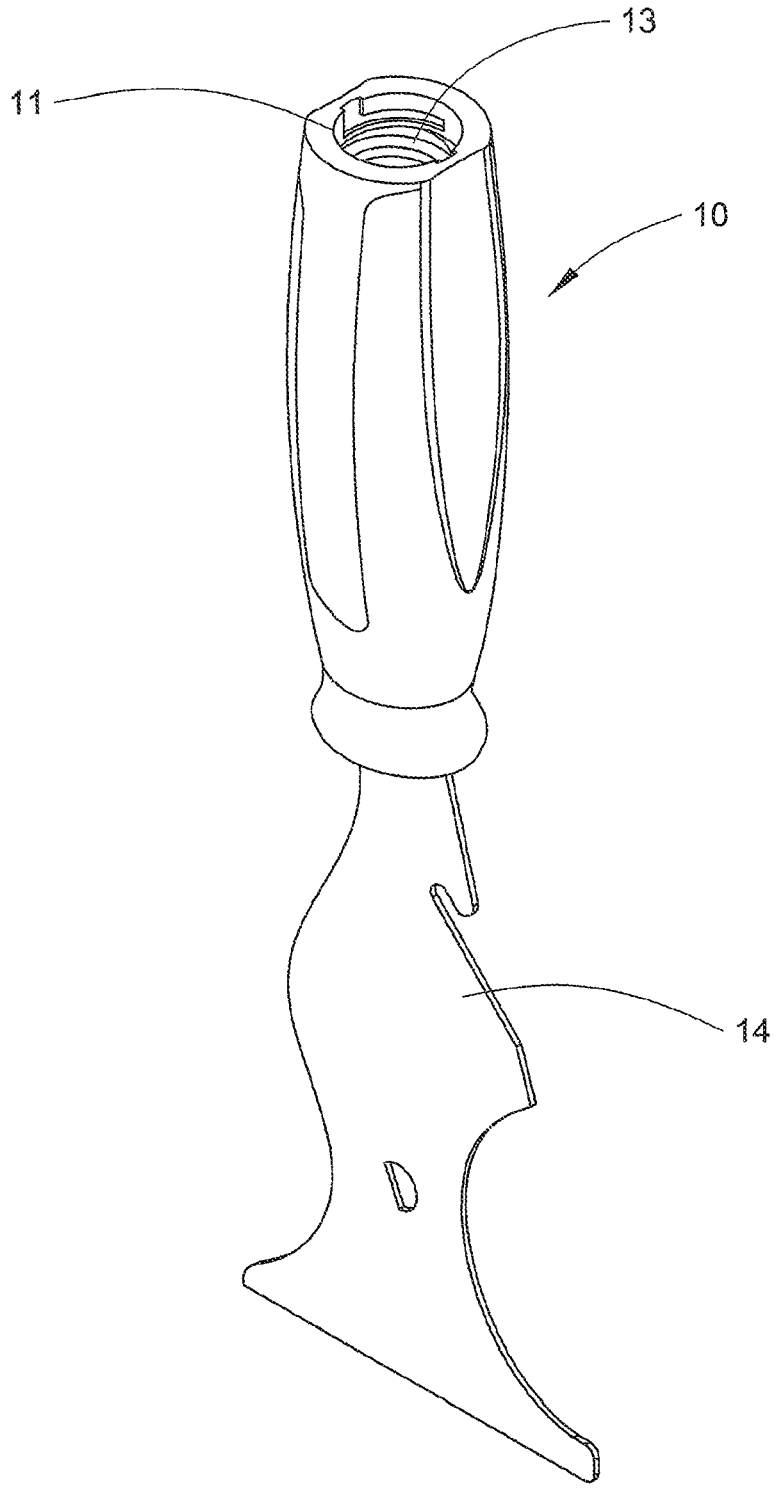
FIG. 9 is a perspective view of a second embodiment in the present invention.
Figure 10:
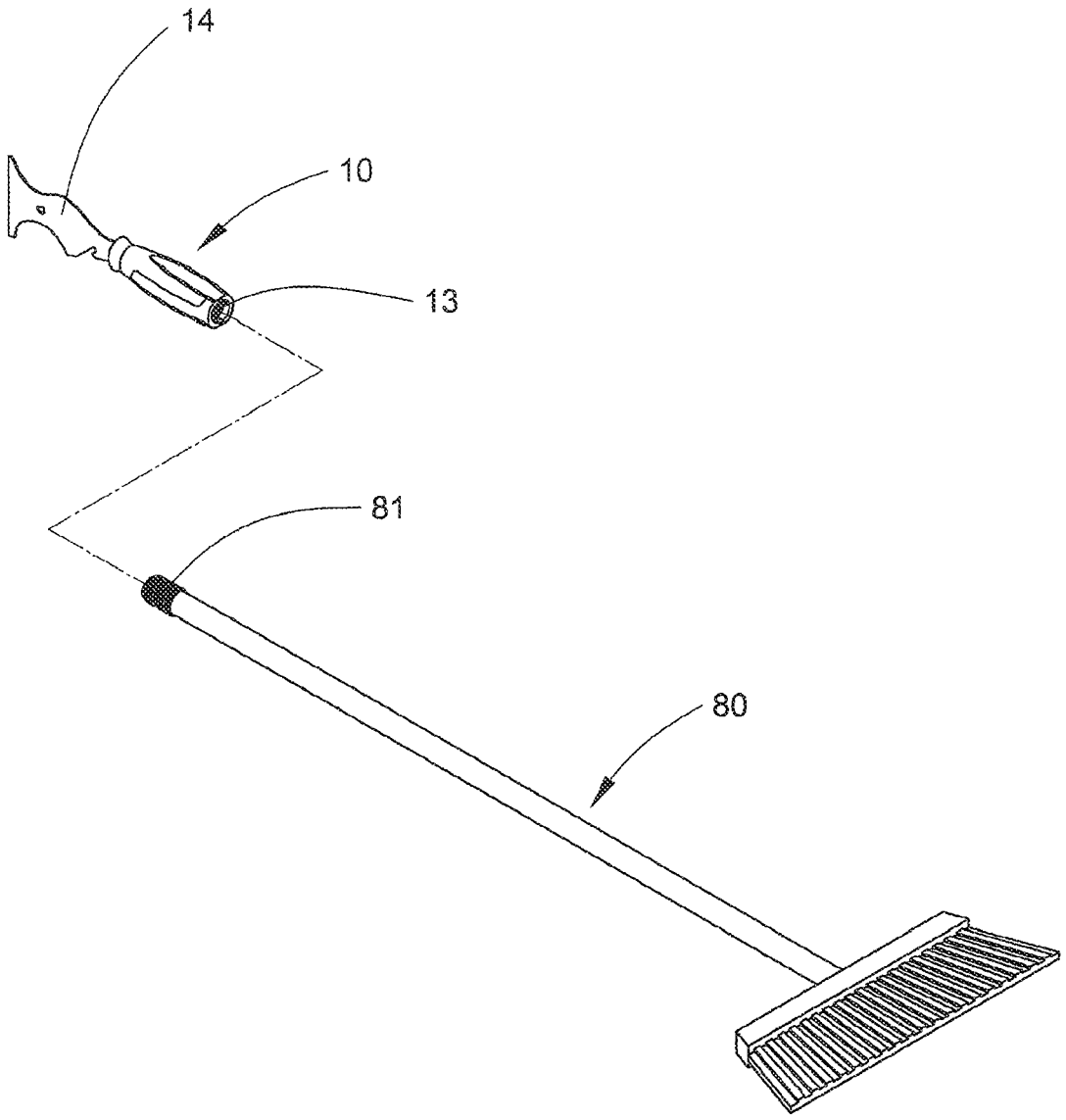
FIG. 10 illustrates combining of an embodiment of the present invention with a commercially available broom.
Figure 11:
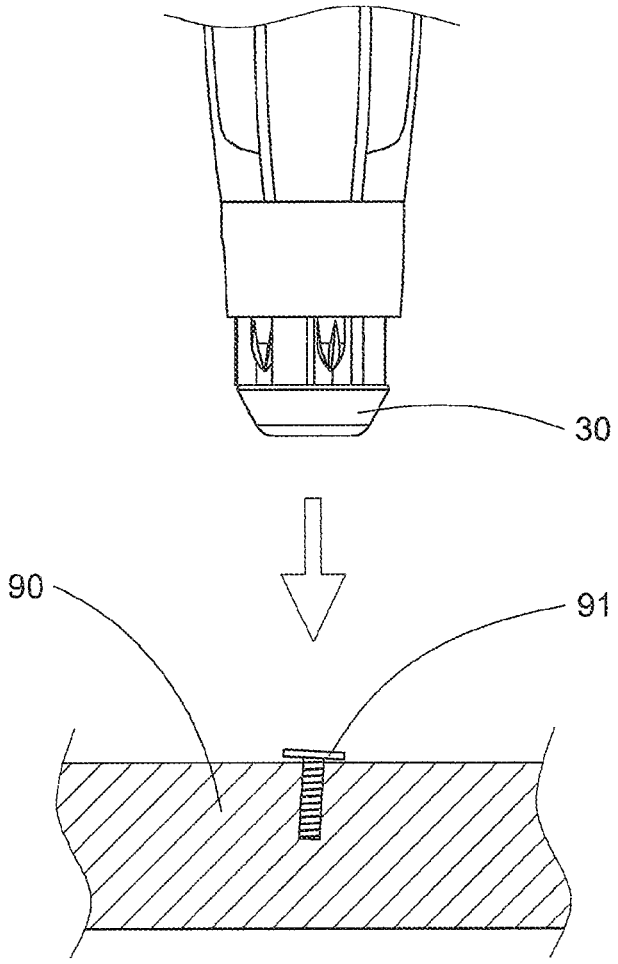
FIG. 11 illustrates an embodiment of the present invention being used for knocking.

Referring to Diagram 1 to Diagram 5, the present invention is a multi-functional tool structure, consisting of a handle 10, a base 20, a cover 30 and a sleeve 40.

With regard to the handle 10, it is made by plastic injection molding; the top part of the handle 10 comprises an annular opening 11 and two engaging recesses 12, while the two engaging recesses 12 are equidistantly recessed on the inner surface of the annular opening 11.

The base 20 is of cylindrical shape with multiple stops 21, multiple slots 22 and a bottom part 23. The stops 21 and the slots 22 are arranged in a staggered manner on the outer periphery of the base 20, where the top end of each stop 21 has a first joint 211, while the outer side of one of the stops 21 has an elastic assembly 212. The slot 22 is used for accommodating a tool head 70, while the bottom part 23 has at least two engaging protrusions 231 and a tool fixing recess 232. The engaging protrusions 231 are used for engaging the engaging recesses 12 on the handle 10, while the tool fixing recess 232 is used for fixing the tool head 70 (refer to Diagram 3). In this embodiment, the tool head 70 has a movable end 71 and a fixed end 72, where the fixed end 72 is used for fixing the tool fixing recess 232 on the base 20, and the cross-sectional of the fixed end 72 is hexagonal in shape, while the tool fixing recess 232 is a corresponding hexagonal recess. Indeed, the type of tool head 70 in each slot 22 can be arbitrarily matched according to the user's needs.

In terms of design, the engaging recess 12 comprises a guiding slot 121 and an engaging slot 122. The guiding slot 121 and the engaging slot 122 are recessed downward on the inner surface of the annular opening 11. The guiding slot 121 is recessed from the top surface of the annular opening 11 downward, while the engaging slot 122 is located below the guiding slot 121, and one end is connected to the guiding slot 121. In the assembly of the handle 10 and the base 20, the engaging protrusion 231 is first connected to one end of the engaging slot 122 via the guiding slot 121, then the base 20 is rotated clockwise (it is designed to be clockwise in this embodiment; in practice, it can also be designed to be anticlockwise), such that the engaging protrusion 231 is abutted against the other end of the engaging slot 122, so as to complete the assembly of the handle 10 and the base 20. With respect to the number of engaging slots 12 and engaging protrusions 231, the present invention is described in terms of two-phase symmetrical design, and their numbers can be changed according to different needs during production.

With regard to the cover 30, multiple second joints 31 are provided on its bottom surface, and are used for connecting the first joints 211 on the base 20. In this embodiment, the first joint 211 is a recessed hole, while the second joint 31 is a corresponding bump. The cover 30 is joined to the base 20 by a combination of recessed holes and bumps. In terms of design, the arrangement of recessed holes and bumps are interchangeable, such that the first joint 211 is a bump, and the second joint 31 is a recessed hole. Besides, the first joints 211 and the second joints 31 are closely fitted.

The sleeve 40 is of hollow cylindrical shape, and has a side opening 41 and multiple grooves 42. The side opening 41 is recessed on one side of the sleeve 40, while multiple grooves 42 are designed on the inner surface of the sleeve 40. The sleeve 40 is set on the base 20 and located between the handle 10 and the cover 30, while the elastic assembly 212 is abutted against the grooves 42. When the sleeve 40 is rotated by an external force, the elastic assembly 212 is temporarily deformed to switch to the corresponding groove 42.

Therefore, while in use, after the handle 10 is separated from the base 20, the side opening 41 will correspond to one of the tool heads 70 by rotation of the sleeve 40, such that the tool head 70 can be removed from the side opening 41, and fixed to the tool fixing recess 232 on the base 20 before use.

As shown in Diagram 2, there are a side recessed hole 212A, an elastic element 212B and a steel ball 212C in the design of the elastic assembly 212, where the side recessed hole 212A is set on the outer side of the stop 21, while the elastic component 212B can serve as a spring as both of its ends are abutted against the end wall of the side recessed hole 212A and the steel ball 212C respectively. The steel ball 212C is abutted against the groove 42 on the sleeve 40 by the elastic force of the elastic component 212B (as shown in Diagram 5). Therefore, the steel ball 212C can maintain an appropriate engagement relationship with the groove 42 through the effect of elastic force exerted by the elastic component 212B. When the sleeve 40 is rotated by an external force, the steel ball 212C is separated from the groove 42, and the inner surface of the sleeve 40 forces the steel ball 212C to compress the elastic component 212B, so as to switch to the corresponding groove 42 (This is a common segmented positioning technique and will not be described in detail here).

To be more detailed, in terms of storing and using the tool, the present invention can be easily achieved by the rotation of the sleeve 40. For instance, when the side opening 41 on the sleeve 40 corresponds to the stop 21, the sleeve 40 can fix the position of each tool head to each slot 21, which is the storage state (i.e. the state shown in Diagram 1). As shown in Diagram 6, when the user wants to use the tool head 70, the user only has to rotate the sleeve 40 to prompt the side opening 41 corresponds to the slot in which the tool head 70 is placed, so that the tool head 70 can be taken out from the side opening 41 (as shown in Diagram 7 and Diagram 8). Lastly, the fixed end of the tool head 70 is assembled to the too fixing recess 232 on the base 20 before use (i.e. the state shown in Diagram 3 and Diagram 4).

As shown in Diagram 9, with regard to the handle 10, it can be further provided with an internally threaded hole 13 and a cutter 14. The internally threaded hole 13 is disposed below the annular opening 11 and passes through the annular opening, while the cutter 14 is fixed to the handle 10, and extends outward from the bottom part of the handle 10. Structure-wise, the cutter 14 can be a metal cutter, such as scraper, can opener and other common functions in our daily lives being integrated into a cutter. Production-wise, the handle 10 is plastically formed on the cutter 14 in the present invention, thereby mutually fixing the cutter 14 together with the handle 10.

As shown in Diagram 10, while in use, the internally threaded 13 can be combined with the external thread 81 on the outer end of a commercially available broom 80 (or other items with external thread on the outer end), such that the overall length of the handle 10 is increased, thereby increasing the scope of use and height of the cutter 14.

In addition, the cover 30 is made of a metal material (e.g., galvanized copper), and has the advantage of being knockable, where the hardness of the metal can be used to reduce the damage resulted from the knocking process. As shown in Diagram 11, when a locking part 91 is locked to the surface of a predetermined object 90 and its end is not flat, the present invention can be used for knocking after aligning the cover 30 to the locking part 91, thereby leveling the end of the locking part 91.

From the description above, it indicates that the present invention enables the required tool head 70 be quickly taken out for use by the rotation of the sleeve 40. The external sizes will also be relatively compact through such storage practice, and will significantly contribute in convenience in terms of usage and carry.

The detailed description above enables those who are skilled in this art to understand that the present invention can achieve the aforementioned purpose. As it has already complied with the provisions of the Patent Act, we would like to file a patent application for the present invention.

The invention claimed is:

1. A multi-functional tool structure, comprising:

a handle, a top part of the handle comprising an annular opening and at least two engaging recesses, each engaging recess recessed equidistantly on an inner surface of the annular opening, each engaging recess comprising a guiding slot and an engaging slot, the guiding slot and the engaging slot recessed on the inner surface of the annular opening, the guiding slot extending downward from a top surface of the annular opening, the engaging slot disposed below the guiding slot, an end of the engaging slot connected to the guiding slot;

a base, the base comprising multiple stops, multiple slots, and a bottom part, the multiple stops and the multiple slots alternatingly disposed along an outer periphery of the base, and a top end of each stop having a respective first joint, an outer side of one of the stops having an elastic assembly; wherein each of the multiple slots is configured for accommodating one of a plurality of tool heads, and the bottom part comprises at least two engaging protrusions and a tool fixing recess, the engaging protrusions configured to engage the engaging recesses on the handle, and the tool fixing recess configured for accepting one of the plurality of tool heads;

a cover, multiple second joints disposed on a bottom surface of the cover and configured for engaging with the first joints on the base;

a hollow sleeve comprising a side opening and multiple grooves, the side opening disposed on one side of the sleeve, the multiple grooves disposed on an inner surface of the sleeve, the sleeve disposed on the base and located between the handle and the cover, the elastic assembly abutting the grooves; wherein when the sleeve is rotated by an external force, the elastic assembly is deformed in order to switch to one of the corresponding grooves;

wherein the handle is separable from the base, the side opening is capable of corresponding to the one of the tool heads by rotation of the sleeve, such that the one of the tool heads is accessible from the side opening for fixing to the tool fixing recess on the base.

2. The multi-functional tool structure as claimed in claim 1, wherein the elastic assembly comprises a side recessed hole, an elastic component and a steel ball, the side recessed hole disposed on the outer side of one of the stops, and ends of the elastic component abut against an end wall of the side recessed hole and the steel ball respectively, the steel ball abutting against the grooves on the sleeve by an elastic force of the elastic component.

3. The multi-functional tool structure as claimed in claim 1, wherein the base and the sleeve are cylindrical.

4. The multi-functional tool structure as claimed in claim 1, wherein the handle comprises an internally threaded hole and a cutter, the internally threaded hole is disposed below the annular opening, and the cutter is fixed to the handle and extends outward from a bottom part of the handle.

5. The multi-functional tool structure as claimed in claim 1, wherein the cover is made from metal.

6. The multi-functional tool structure as claimed in claim 1, wherein each of the tool heads comprise a fixed end, the fixed end configured for securing to the tool fixing recess on the base.

7. The multi-functional tool structure as claimed in claim 6, wherein a cross-sectional shape of the fixed end corresponds to a shape of the tool fixing recess.

* * * * *